US008302567B2

(12) United States Patent
Junginger

(10) Patent No.: US 8,302,567 B2
(45) Date of Patent: Nov. 6, 2012

(54) COOLING AIR PASSAGE FOR A MOTOR CHAIN SAW

(75) Inventor: Wolfgang Junginger, Weinstadt (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 404 days.

(21) Appl. No.: 12/616,443

(22) Filed: Nov. 11, 2009

(65) Prior Publication Data

US 2010/0122674 A1 May 20, 2010

(30) Foreign Application Priority Data

Nov. 14, 2008 (DE) ..... 10 2008 057 405

(51) Int. Cl.
*F01P 1/02* (2006.01)

(52) U.S. Cl. ..... 123/41.7; 123/41.31; 123/41.56; 123/41.69; 30/381; 181/264

(58) Field of Classification Search ..... 123/41.31, 123/41.56, 41.65, 41.69, 41.7, 195 C, 198 E; 30/381–383; 181/264
See application file for complete search history.

(56) References Cited

U.S. PATENT DOCUMENTS 4,770,130 A * 9/1988 Nagashima ..... 123/41.67
4,867,270 A * 9/1989 Wissmann et al. ..... 181/231

* cited by examiner

*Primary Examiner* — Noah Kamen
*Assistant Examiner* — Hung Q Nguyen
(74) *Attorney, Agent, or Firm* — Gudrun E. Huckett

(57) ABSTRACT

A motor chain saw has a motor housing with a drive unit for driving a saw chain on a guide bar. The drive unit is an internal combustion engine with a cylinder and a crankshaft extending transversely to a longitudinal axis of the motor chain saw. A drive pinion is mounted on a first end of the crankshaft. A cooling air blower with a blower wheel is mounted on the second end of the crankshaft. A cooling air stream of the blower flows transversely to the longitudinal axis of the motor chain saw about the cylinder and exits through a housing opening. A hand guard arranged between a handle and a front end of the guide bar is connected with one leg near the housing opening for the cooling air stream. In front of the housing opening a baffle element is supported on the leg of the hand guard.

13 Claims, 2 Drawing Sheets

COOLING AIR PASSAGE FOR A MOTOR CHAIN SAW

BACKGROUND OF THE INVENTION

The invention relates to a motor chain saw that comprises an internal combustion engine for driving a saw chain circulating about a guide bar. The crankshaft of the internal combustion engine is oriented transversely to a longitudinal axis of the motor chain saw and supports at a first end a drive pinion for the saw chain as well as at the second end a blower wheel of a cooling air blower. The cooling air stream that is sucked in by the cooling air blower is supplied transversely to the longitudinal axis of the motor chain saw for cooling the cylinder of the internal combustion engine, flows about the cylinder positioned between the drive pinion and the cooling air blower, and then is blown out through a housing opening at the opposite longitudinal side. The motor chain saw further has a handle that extends across the motor housing transversely to the longitudinal axis and a hand guard that is arranged between the handle and the front end of the guide bar and is secured with at least one leg in the area of the housing opening for the cooling air.

Modern internal combustion engines, in particular single-cylinder internal combustion engines, are operated with a lean mixture for environmental reasons; this may cause an increased operating temperature. In order to ensure a satisfactory cooling action, a corresponding volume stream of cooling air must flow through the motor housing. On the other hand, increased operating temperatures also cause a corresponding heating of attached parts, for example, the exhaust gas muffler.

It is therefore an object of the present intention to not only sufficiently cool the internal combustion engine with a cooling air stream but also to supply cooling air to an exhaust gas muffler that is attached to the cylinder.

SUMMARY OF THE INVENTION

In accordance with the present invention, this is achieved in that in front of (downstream of) the housing opening for the cooling air an air guiding element or baffle element is arranged that is supported on the leg of the hand guard.

The air guiding element or baffle element that is arranged in front of the housing opening has a sufficient spacing relative to the cylinder as well as to the housing opening so that a disruption of the cooling air stream within the motor housing is substantially avoided by this arrangement of the baffle element. For this purpose, the baffle element is supported on the leg of the hand guard that, as a result of its constructive configuration, is secured on the longitudinal side of the motor housing where the housing opening is located. With this design in accordance with the present invention the position of the leg of the hand guard in front of the housing opening is utilized in order to position a baffle element that deflects or diverts a part of the exhausted blower air stream to the exhaust gas muffler so that cooling of the exhaust gas muffler without impairment of the cooling air stream about the cylinder is achieved. The partial air stream that is guided to the exhaust gas muffler mixes moreover with the exhaust gas stream that exists from the outlet of the exhaust gas muffler so that already at a minimal distance from the exhaust gas outlet at the exhaust gas muffler a minimal temperature of the outflowing mixed stream of exhaust gas and partial air stream is achieved.

The baffle element supported on the leg of the hand guard is advantageously positioned at a spacing relative to the cylinder. This arrangement is selected such that in a side view onto the motor housing the baffle element covers a gap between the exhaust gas muffler and the cylinder. In this connection, the arrangement can be selected such that the leg of the hand guard is positioned approximately at the level of the gap between exhaust gas muffler and cylinder and the leg itself is configured as the baffle element.

According to a further embodiment of the invention the air guiding element or baffle element is wider than the leg of the hand guard wherein the baffle element in a side view onto the motor housing may extend from the area of the cylinder across the gap of the exhaust gas muffler relative to the cylinder into the area of the exhaust gas muffler.

In a simple embodiment, the baffle element is a shaped wall and in particular is embodied for example to be curved about the longitudinal axis of the motor chain saw. In this connection, it is expedient with regard to its manufacture that the baffle element is formed integrally or monolithically with the leg of the hand guard. The baffle element has preferably a spoon-like configuration.

DESCRIPTION OF THE PREFERRED EMBODIMENTS

Figure 1:
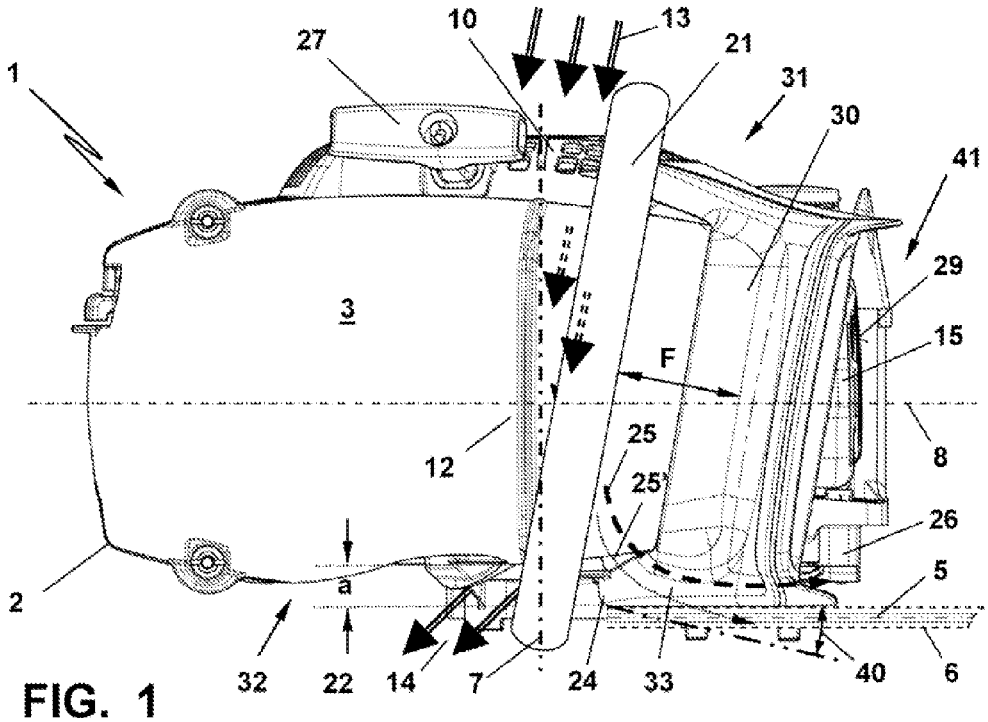
FIG. 1 is a plan view onto a motor chain saw in a part-schematic illustration.
Figure 4:
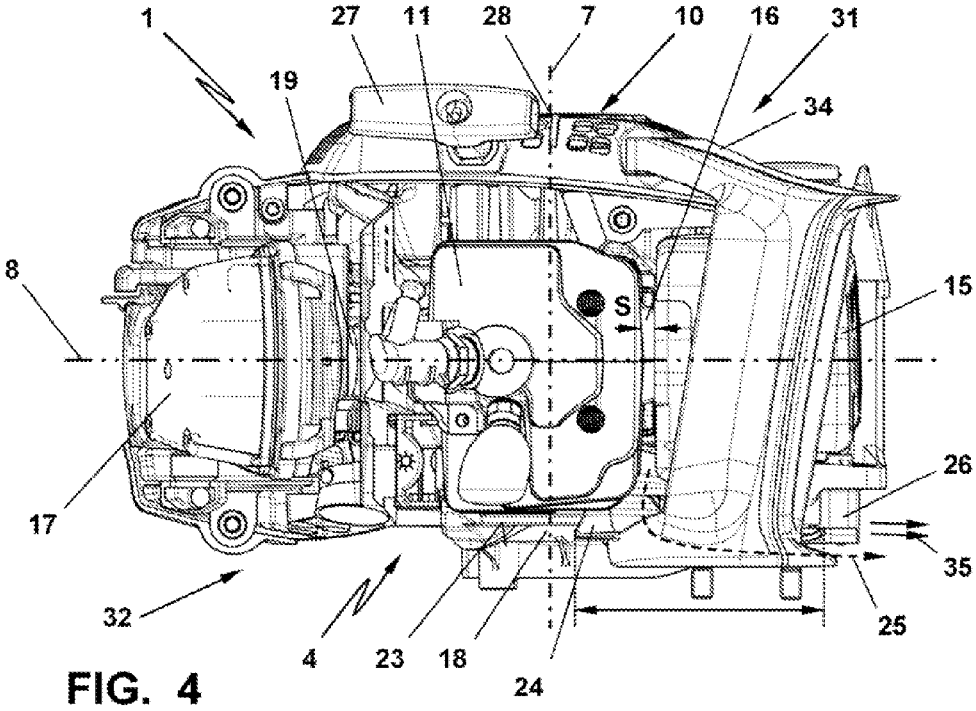
FIG. 4 is a part-schematic plan view onto the motor chain saw according to FIG. 1 with the cover removed.

The portable, hand-guided motor chain saw illustrated in the FIGS. 1 and 4 has a motor housing 2 with a cover 3. A drive unit 4 is arranged in the motor housing 1 and serves for driving a tool, in the illustrated embodiment, a saw chain 5 that circulates in a circumferential groove of a guide bar 6. A starting handle 27 of the starting device is shown.

In the illustrated embodiment, the drive unit is preferably a two-stroke engine, in particular a single-cylinder two-stroke engine, wherein the crankshaft 7 (FIG. 4) of the internal combustion engine is positioned transversely to the longitudinal axis 8 of the motor chain saw 1. In the illustrated embodiment, on the first end 18 of the crankshaft 7 a drive pinion 9 for driving engagement of the saw chain 5 is mounted; the drive pinion 9 is connected by means of a centrifugal clutch 10 with the crankshaft 7.

On the second end 28 of the crankshaft 7 (FIG. 4) a blower wheel of a cooling air blower 10 is attached by means of which the cylinder 11 is supplied with cooling air. The cylinder 11 supports an appropriate arrangement of cooling ribs between which the cooling air stream 12 is guided. The air stream 13 that is sucked in by the cooling air blower 10 passes as a cooling air stream 12 between the cooling ribs of the cylinder 11 and as an exhausted blower air stream 14 exits at the longitudinal side 32 of the motor chain saw 1 that is opposite cooling air blower 10.

In the illustrated embodiment the cylinder 11 provided with cooling ribs is thus positioned between the cooling air blower 10 and the clutch connected to the drive pinion 9 at the opposite end of the crankshaft 7. This clutch is preferably embodied as a centrifugal clutch 20.

The auxiliary devices required for the internal combustion engine are arranged in front of and behind the cylinder 11, viewed in the direction of the longitudinal axis 8 of the motor chain saw 1. The exhaust gas muffler 15 is thus positioned in front of the crankshaft 7, i.e., on the side of the crankshaft 7 where also the guide bar 6 with the circulating saw chain 5 is provided. The exhaust gas muffler 15 is mounted immediately on an outlet flange 16 of the cylinder 11 in such a way that between the cylinder 11 and the exhaust gas muffler 15 a gap S remains. Preferably, a portion of the cooling air stream 12 passes through the gap S so that an improved thermal decoupling of the exhaust gas muffler 15 from the cylinder 11 is provided.

Behind the cylinder 11 of the internal combustion engine, i.e., on the side of the crankshaft 7 that is facing away from the guide bar 5, the intake manifold of the internal combustion engine is provided. In FIG. 4 an air filter 17 is illustrated that supplies by intake passage 19 combustion air to the internal combustion engine. By means of a suitable fuel metering device the internal combustion engine is supplied in operation with the required quantity of fuel.

Figure 2:
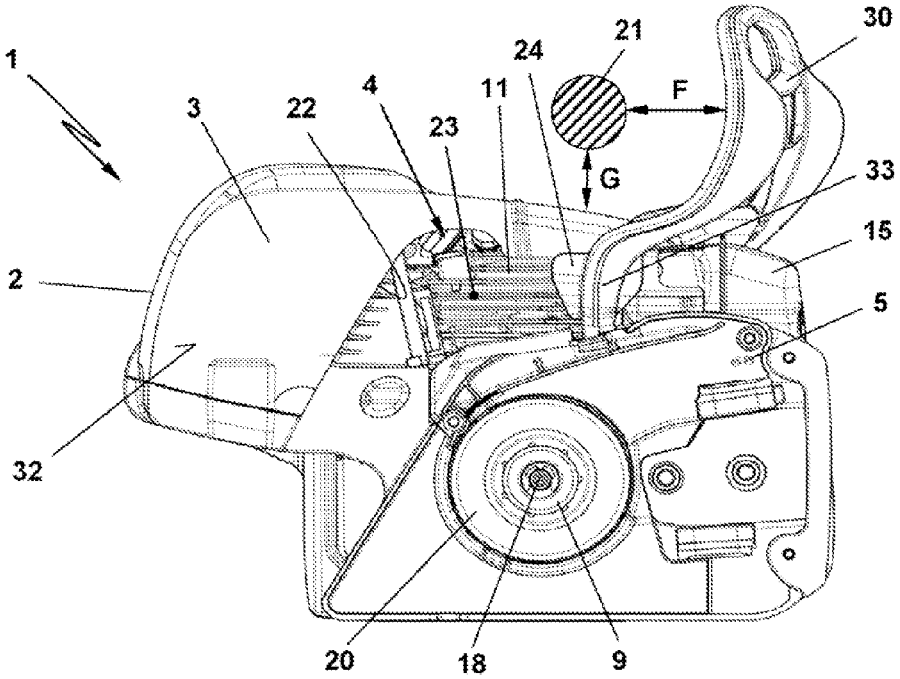
FIG. 2 is a view onto the motor chain saw according to FIG. 1 in part-schematic illustration.

The motor housing 2 comprises a cover 3 that, as shown in FIGS. 1 and 2, covers the intake manifold of the internal combustion engine with air filter 17 and intake passage 19 as well as the cylinder 11. The cover or the motor housing covers the gap S and extends also partially across the exhaust gas muffler 15.

For holding and guiding it, the motor chain saw comprises inter alia a front handle 21 that extends transversely to the longitudinal axis 8 at a gripping distance G across the cover 3 or the motor housing 2. In a way not disclosed in detail, the front handle 21 may extend from the longitudinal side 31 of the motor chain saw where the cooling air blower 10 is located to the opposite longitudinal side 31 of the motor chain saw where the guide bar 6 is located. The front handle 21 is preferably positioned at an angle of less 90 degrees relative to the longitudinal axis 8, i.e., is positioned at an angle relative to the crankshaft 7. The front handle 21 is positioned relative to the crankshaft 7 at an acute angle of for example 0 degrees to 50 degrees.

Positioned in front of the front handle 21 there is a hand guard 30 that is positioned spaced with a free space F at a distance in front of the front handle 21. The hand guard 30 extends substantially parallel to the front handle 21 and has at least one leg 33 with which the hand guard 30 is secured on longitudinal side 31 or 32. In the illustrated embodiment, the hand guard 30 is pivotably supported and serves as a trigger for a safety brake device that acts on the output side of the centrifugal clutch 20 and thus on the drive or chain pinion 9.

FIG. 4 shows that in the illustrated embodiment the hand guard 30 is of a U-shaped configuration and is supported with one leg 33 on longitudinal side 32 of the motor chain saw and with the other leg 34 on the other longitudinal side 31 so as to be pivotable.

As shown in FIG. 2, the motor housing 2 or the cover 3 is provided at the longitudinal side 32 with a housing opening 22 that extends substantially across the entire narrow side 23 of the cylinder 11, measured in the direction of the longitudinal axis 8, across the gap S and beyond and extends into the area of the exhaust gas muffler 15. The motor housing 2 or the cover 3 delimits in this way a housing opening 22 that is positioned on the longitudinal side 32 of the motor chain saw 1 and extends approximately across the length of the drive unit 4.

The exhausted blower air stream 14 exits through the housing opening 22 so that the cooling air stream 12 is guided transversely to the longitudinal axis 8 through the motor housing 2.

The leg 33 of the hand guard 30 extends on the longitudinal side 32 of the motor housing 2 in the area of the housing opening 22 approximately at the level of the gap S between the exhaust gas muffler 15 and the cylinder 11. As shown in FIG. 1, the leg 33 of the hand guard 30 is positioned at a spacing a relative to the cylinder 11 or to the housing opening 22.

According to the present invention, in the area of the leg 33 of the hand guard 30 a baffle element 24 is arranged that changes the exhausted blower air stream 14. For this purpose, the baffle element 24, without impairing the exhausted blower air stream 14, branches off a partial stream 25 and deflects it approximately in the direction of the longitudinal axis 8, preferably parallel to the longitudinal side 52 in the forward direction toward the exhaust gas muffler 15. The partial air stream 25 therefore exists at the front end face 29 of the exhaust gas muffler 15 so that the latter is cooled well. In a special embodiment of the invention the partial air stream 25 is guided into the area of the exhaust gas outlet 26 so that the partial air steam 25 and the exhaust gas stream exiting from the outlet 26 will mix with one another. In this way, the temperature of the outflowing mixed stream can be significantly lowered. Low temperatures can thus be ensured in the vicinity of the exhaust gas muffler 15 or the power tool.

In a simple embodiment, the leg 33 of the hand guard 30 is formed as an air guiding element (baffle element) 24 so that at least the partial air stream 25 that has flown through the gap S between exhaust gas muffler 15 and internal combustion engine 11 transversely to the longitudinal axis 8 of the motor housing 1 is deflected forwardly toward the end face 29 of the exhaust gas muffler 15. Since the leg 33 that is embodied as a baffle element 24 is positioned at a spacing z to the cylinder 11 (FIG. 3) as well as at a spacing a to the housing opening 22 (FIG. 1) the partial air stream 25 is branched off only after the exhausted blower air stream 14 has exited from the housing. This ensures that the cooling air stream in the motor housing remains substantially unimpaired by the baffle element 24.

Preferably, the baffle element 24 is embodied as a baffle wall 29 that is supported on the leg 33 of the hand guard 30. The thus formed baffle element 24 covers in a side view onto the motor housing 1 that gap S between the exhaust gas muffler 15 and the cylinder 11. In this connection, the baffle element 24 is wider than the leg 33 of the hand guard 30 so that in the side view onto the longitudinal side 32 of the motor housing 1 it extends from the area of the cylinder 11 across the gap S of the muffler 15 relative to the cylinder into the area of the exhaust gas muffler 15 itself. As can be seen in FIG. 2, the baffle element 24, viewed in the direction of longitudinal axis 8, projects past the leg 33 in the direction toward the exhaust gas muffler 15 as well as in the direction toward the cylinder 11.

Figure 3:
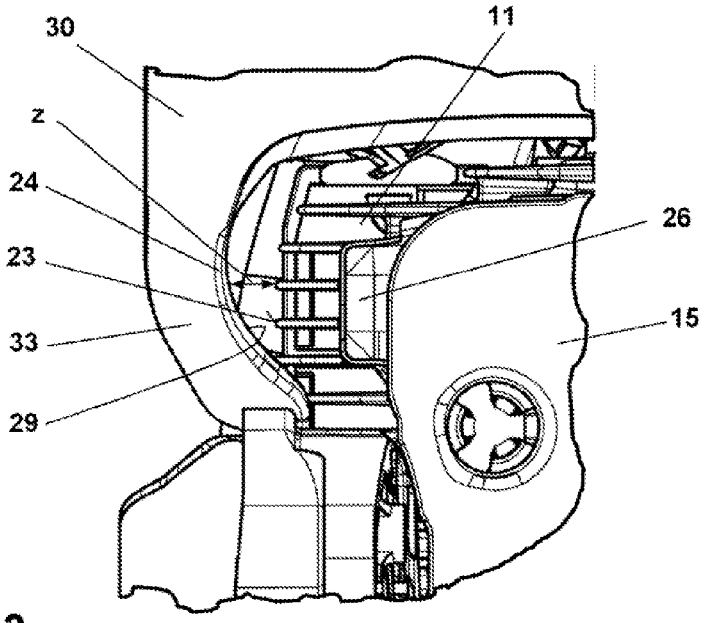
FIG. 3 is a detail view onto a baffle element that is arranged on the hand guard, viewed from the front end.

As shown in FIG. 3, the baffle element 24 is preferably configured as a spoon-shaped wall 29 that is curved relative to the longitudinal axis 8 of the motor chain saw 1. The curvature is selected such that a satisfactory spacing z to the cylinder 11 is obtained. The height of the baffle element 24 extends substantially across the entire height of the blower opening 22 provided in the area of the gap S.

The baffle wall 29, as shown in the Figures, is preferably manufactured as a unitary or monolithic part of hand guard 30; the hand guard 30 is in particular comprised of plastic material.

It can be expedient to design the overlap of the baffle element 24 with the exhaust gas muffler 15 to be larger than the overlap of the baffle element 24 with the cylinder 11. This can be seen in the side view of FIG. 2 as well as in the plan view of FIG. 4.

As indicated in dashed lines in FIG. 1, the baffle element 24 can also be positioned relative to the longitudinal axis 8 of the motor chain saw 1 at an angle 40. In this way, the branched-off partial air stream 25' (dotted line) is deflected less strongly so that, as a whole, a reduced disruption of the cooling air stream results. The angle 40 is within a range of approximately 0 degrees to 30 degrees. The baffle element 24 is thus positioned at an angle 40 that opens in a direction toward the end face 41 of the motor chain saw 1 wherein the baffle element 24 is oriented away from the longitudinal side 32 in the outward direction.

The specification incorporates by reference the entire disclosure of German priority document 10 2008 057 405.8 having a filing date of Nov. 14, 2008.

While specific embodiments of the invention have been shown and described in detail to illustrate the inventive principles, it will be understood that the invention may be embodied otherwise without departing from such principles.

What is claimed is:

1. A motor chain saw comprising:

a motor housing;

a guide bar connected to said motor housing;

a saw chain arranged on said guide bar;

a drive unit arranged in said motor housing for driving said saw chain so as to circulate on said guide bar;

wherein said drive unit comprises an internal combustion engine having a cylinder and a crankshaft, wherein said crankshaft extends transversely to a longitudinal axis of the motor chain saw, and further comprises a drive pinion for said saw chain mounted on a first end of said crankshaft and a cooling air blower with a blower wheel mounted on a second end of said crankshaft opposite said drive pinion, wherein a cooling air stream of said cooling air blower flows transversely to a longitudinal axis of the motor chain saw about said cylinder that is positioned between said drive pinion and said cooling air blower and exits as an exhausted blower air stream through a housing opening of said motor housing;

an exhaust gas muffler mounted on said cylinder;

at least one handle that spans said motor housing transversely to said longitudinal axis;

a hand guard arranged between said at least one handle and a front end of said guide bar and comprising at least one leg connected to said motor housing in an area of said housing opening for said cooling air steam;

wherein, in a side view onto said motor housing, in front of said housing opening a baffle element is arranged that branches off a partial stream from said exhausted blower air stream exiting from said housing opening and deflects said partial stream toward said exhaust gas muffler, wherein said baffle element is supported on said at least one leg of said hand guard.

2. The motor chain saw according to claim 1, wherein said baffle element is positioned at a spacing relative to said cylinder.

3. The motor chain saw according to claim 1, wherein, in a side view onto said motor housing, said baffle element covers a gap between said exhaust gas muffler and said cylinder.

4. The motor chain saw according to claim 3, wherein said at least one leg of said hand guard is positioned approximately at a level of said gap between said exhaust gas muffler and said cylinder and said baffle element is formed by said at least one leg.

5. The motor chain saw according to claim 3, wherein said baffle element, in said side view onto said motor housing, extends from an area of said cylinder across said gap into an area of said exhaust gas muffler.

6. The motor chain saw according to claim 1, wherein said baffle element is wider than said at least one leg of said hand guard.

7. The motor chain saw according to claim 1, wherein said baffle element is a shaped wall.

8. The motor chain saw according to claim 1, wherein said baffle element is curved about said longitudinal axis of the motor chain saw.

9. The motor chain saw according to claim 1, wherein said baffle element is a monolithic part of said at least one leg of said hand guard.

10. The motor chain saw according to claim 1, wherein said baffle element extends substantially at an angle of approximately 0 degrees to 30 degrees relative to said longitudinal axis of the motor chain saw.

11. The motor chain saw according to claim 10, wherein said baffle element extends straight in a direction of said longitudinal axis.

12. The motor chain saw according to claim 5, wherein said baffle element, in said side view onto said motor housing, has an overlap with said exhaust gas muffler and has an overlap with said cylinder.

13. The motor chain saw according to claim 12, wherein said overlap of said baffle element with said exhaust gas muffler is larger than said overlap of said baffle element with said cylinder.

* * * * *